US009623883B2

(12) United States Patent
Sato et al.

(10) Patent No.: US 9,623,883 B2
(45) Date of Patent: Apr. 18, 2017

(54) RAILCAR TRUCK

(71) Applicant: KAWASAKI JUKOGYO KABUSHIKI KAISHA, Kobe-shi, Hyogo (JP)

(72) Inventors: Yoshi Sato, Kobe (JP); Junichi Sakamoto, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 162 days.

(21) Appl. No.: 14/394,620

(22) PCT Filed: Apr. 12, 2013

(86) PCT No.: PCT/JP2013/061100
§ 371 (c)(1),
(2) Date: Oct. 15, 2014

(87) PCT Pub. No.: WO2013/164944
PCT Pub. Date: Nov. 7, 2013

(65) Prior Publication Data

US 2015/0096456 A1 Apr. 9, 2015

(30) Foreign Application Priority Data

May 1, 2012 (JP) ..... 2012-104422

(51) Int. Cl.
*B61F 5/52* (2006.01)
*B61F 3/06* (2006.01)
*B61F 5/06* (2006.01)

(52) U.S. Cl.
CPC ..... *B61F 5/52* (2013.01); *B61F 3/06* (2013.01); *B61F 5/06* (2013.01)

(58) Field of Classification Search
CPC ..... B61F 1/00; B61F 3/00; B61F 3/02; B61F 5/00; B61F 5/02; B61F 5/14; B61F 5/22; B61F 5/24; B61F 5/50; B61F 5/52
See application file for complete search history.

(56) References Cited

U.S. PATENT DOCUMENTS 933,224 A 9/1909 Barber
4,633,786 A 1/1987 Pavlick
(Continued)

FOREIGN PATENT DOCUMENTS

CN 201619580 U 11/2010
EP 0 046 457 A1 2/1982
(Continued)

OTHER PUBLICATIONS

Dec. 10, 2015 Extended Search Report issued in European Patent Application No. 13784456.9.
(Continued)

*Primary Examiner* — R. J. McCarry, Jr.
(74) *Attorney, Agent, or Firm* — Oliff PLC

(57) ABSTRACT

In a railcar truck in which secondary springs are disposed between the railcar truck and a carbody of the railcar, the railcar truck has a pair of side beams having concavities configured to receive the secondary springs. Each of the side beams has a side beam outer wall, a side beam inner wall, a side beam lower wall and a side beam upper wall, and the side beam upper wall includes an opening through which the received secondary spring projects. The concavity is formed by the side beam outer wall, the side beam inner wall and the side beam lower wall, and receive the secondary spring through the opening.

7 Claims, 7 Drawing Sheets

(56) References Cited

U.S. PATENT DOCUMENTS

| | | | | |
|---|---|---|---|---|
| 4,732,372 | A * | 3/1988 | Dickhart, III | B60G 11/16 267/204 |
| 2005/0183625 | A1 | 8/2005 | Goding et al. | |

FOREIGN PATENT DOCUMENTS

| | | | | |
|---|---|---|---|---|
| EP | 0046457 | * | 2/1982 | B61F 3/10 |
| JP | A-61-119462 | | 6/1986 | |
| JP | A-61-150862 | | 7/1986 | |
| JP | A-62-501553 | | 6/1987 | |
| JP | U-04-43568 | | 4/1992 | |

OTHER PUBLICATIONS

International Search Report issued in International Application No. PCT/JP2013/061100 dated Jul. 9, 2013.

* cited by examiner

RAILCAR TRUCK

TECHNICAL FIELD

The present invention relates to a truck for railcars.

BACKGROUND ART

In a railcar truck, secondary springs are arranged between a truck and a carbody of a railcar in order to suppress so-called rolling in the railcar and moderate impact applied to the carbody during running. As shown in FIGS. 7 and 8, for example in an electric locomotive, a secondary spring 30 is placed between a truck 10 and an under-frame 21 of a carbody 20 of the electric locomotive. In this case, the secondary spring 30 is placed in a configuration that a lower end surface 30*a* of the secondary spring 30 is placed on an upper surface 11*a* of a side beam 11 of the truck 10.

PRIOR ART DOCUMENT

Patent Document

Patent Document 1: Specification of Chinese Utility Model Application No. CN201619580

SUMMARY OF THE INVENTION

Problems to be Solved by the Invention

However, in the configuration that the secondary spring 30 is placed on the upper surface 11*a* of the side beam 11 of the truck 10 as shown in FIGS. 7 and 8, a position of an upper end surface 30*b* of the secondary spring 30 is at a position corresponding to a height of the secondary spring 30. As a result, a floor level of the carbody 20 is compelled to be set high, or several ways have been contrived to prevent the floor level of the carbody 20 from increasing. For example, only a portion of the carbody under-frame 21 which corresponds to the secondary spring 30 is recessed to secure an installation space 22 for the secondary spring 30 as shown in FIG. 7. However, if the installation space 22 is provided, a space for equipment within the carbody 20 is reduced and correspondingly, it becomes necessary to increase a length of the carbody and this increases production costs of the locomotive.

The present invention has been made in order to solve such problems, and it is an object thereof to provide a railcar truck capable of securing a space for equipment within a carbody, and capable of reducing production costs of a railcar as compared with the conventional technique.

Means for Solving the Problems

To achieve the above object, the present invention is configured as follows.

A railcar truck according to a first aspect of the present invention is a railcar truck configured to support a carbody via secondary springs, the railcar truck comprising a pair of side beams having concavities configured to receive the secondary springs, each of the side beams includes:

a side beam outer wall located on an outer side in a railcar width direction and extending in a railcar-longitudinal direction;

a side beam inner wall located on an inner side with respect to the side beam outer wall in the railcar width direction and extending in the railcar-longitudinal direction;

a side beam lower wall extending in the railcar-longitudinal direction and on which the secondary spring is placed; and a side beam upper wall having an opening through which an upper portion of the received secondary spring projects, the side beam upper wall extending in the railcar-longitudinal direction, each of the concavities being formed by the side beam outer wall, the side beam inner wall and the side beam lower wall, and receiving the secondary spring through the opening, and in each of the side beams, a cross-sectional area of an opening-existing portion where the opening is formed being greater than a cross-sectional area of an opening-non-existing portion where the opening is not formed.

The railcar truck is configured as described above. That is, the secondary spring is received in the concavity in the side beam of the truck, and the upper portion of the secondary spring is made to project through the opening of the upper wall of the side beam. Therefore, the height of the secondary spring projecting from the truck can be lowered as compared with the conventional technique. Hence, it is unnecessary to provide the carbody with the recessed installation space for the secondary spring unlike the conventional technique, and it is possible to reduce the production costs of the railcar as compared with the conventional technique.

Effects of the Invention

According to the present invention, it is possible to provide a railcar truck capable of securing a space for equipment within a carbody, and capable of reducing production costs of a railcar as compared with the conventional technique.

EMBODIMENT OF THE INVENTION

Figure 1:
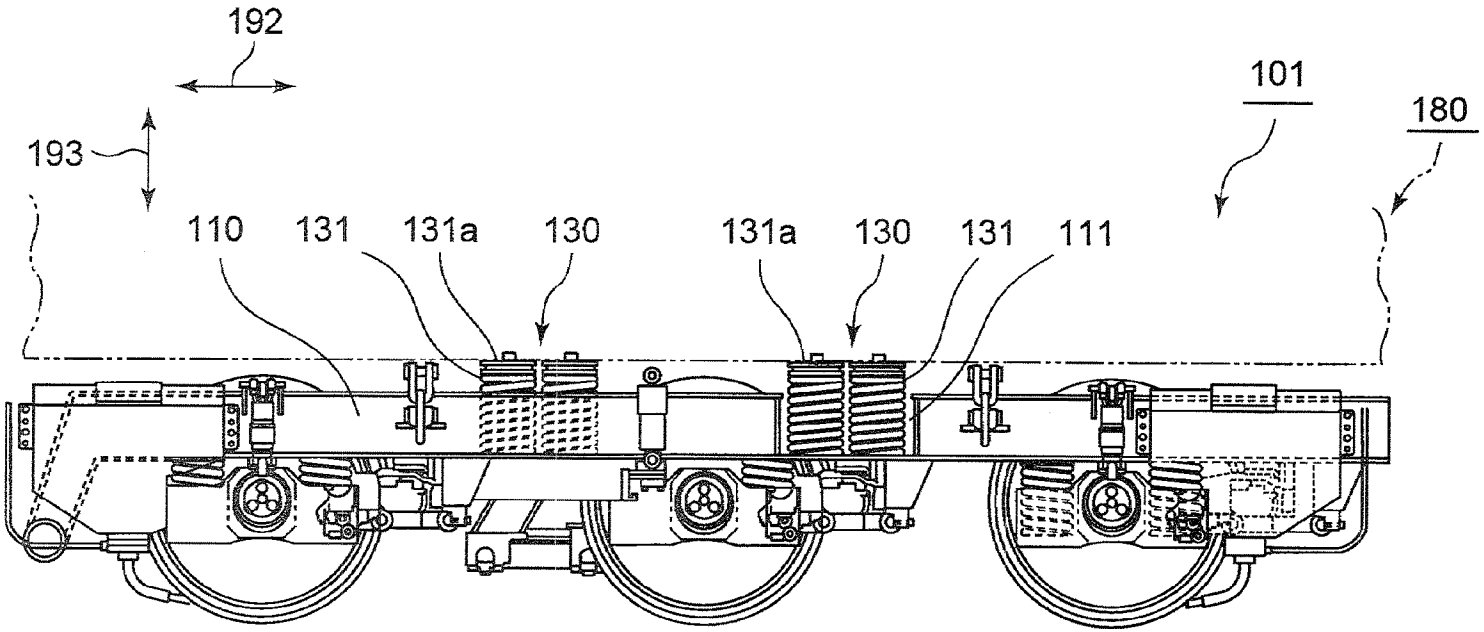
FIG. 1 is a side view showing one example of a railcar truck in an embodiment of the present invention.

A truck for railcars (a railcar truck) of an embodiment will be described below with reference to the drawings. Note that the same reference symbols are allocated to the same or similar components in the drawings. Although a three-axle truck for an electric locomotive is employed as an example in the following description and the drawings, however the railcar truck of the embodiment is not limited to this, and the present invention can be applied also to a two-axle truck for an electric train or the like, of course.

Figure 2:
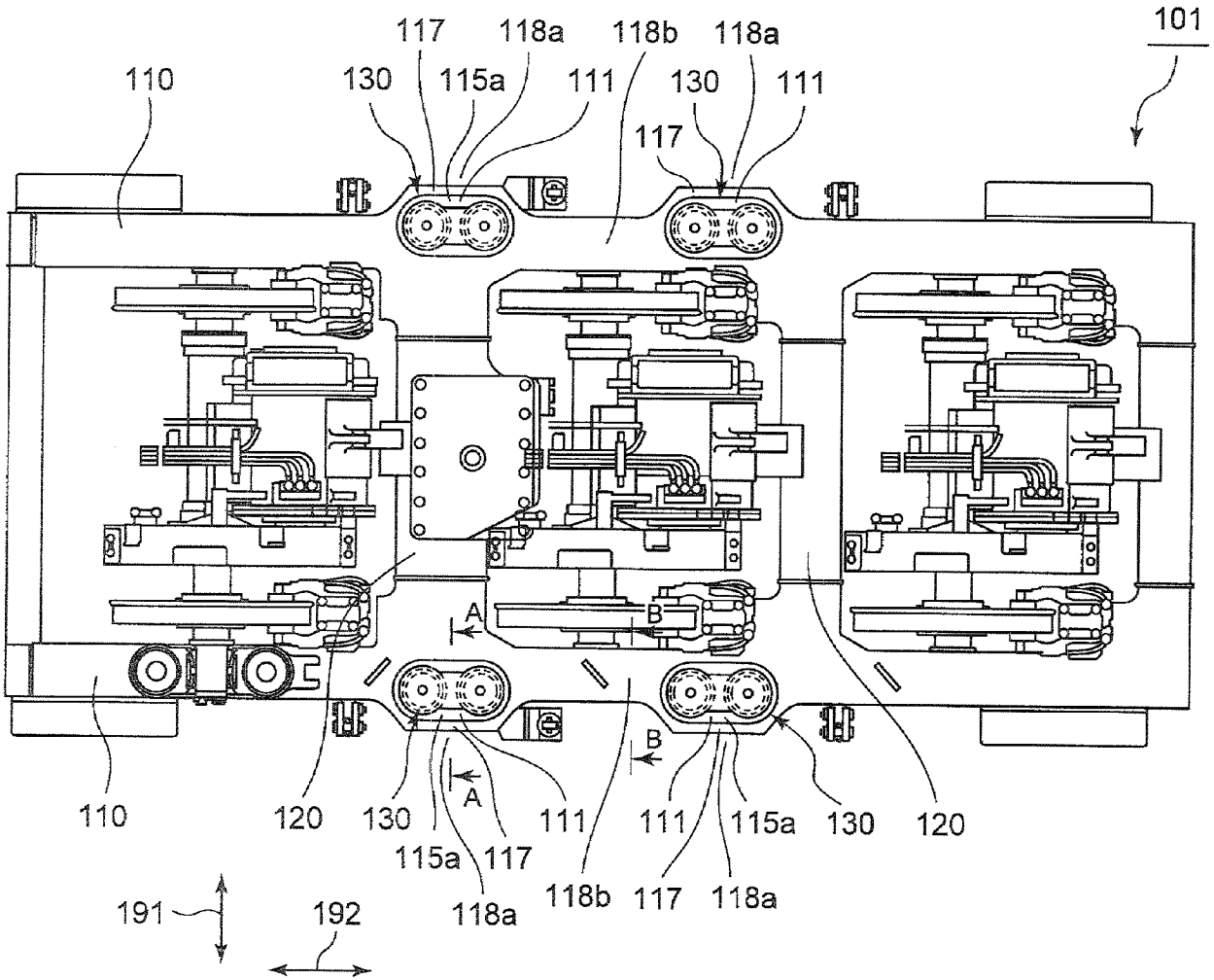
FIG. 2 is a plan view of the railcar truck shown in FIG. 1.

FIGS. 1 and 2 show a three-axle truck 101 for an electric locomotive which corresponds to one example of the railcar truck of this embodiment. The truck 101 supports a carbody 180 of the electric locomotive with secondary springs 130 interposed between the truck 101 and a floor of the carbody 180. The truck 101 includes side beams 110 as a basic configuration.

Figure 3:
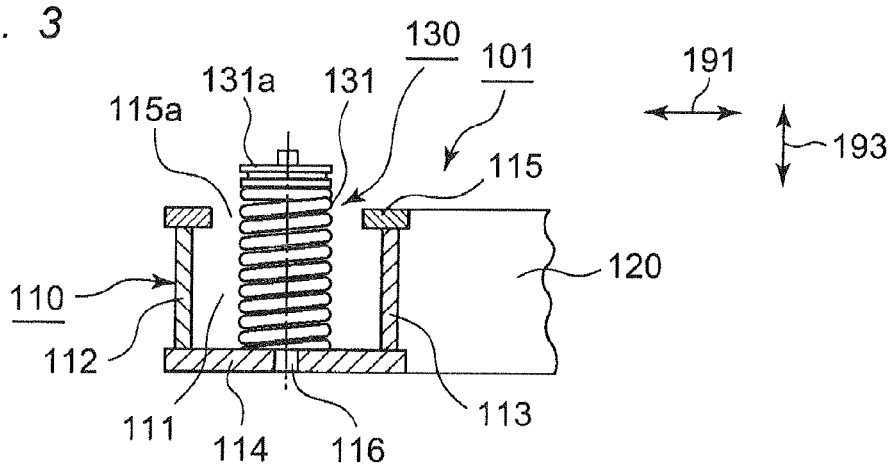
FIG. 3 is a sectional view cut along a portion A-A in FIG. 2.

The side beams 110 are provided on both right and left sides of the truck 101 in a railcar width direction 191. The side beams 110 extend in a railcar-longitudinal direction 192 and support axles, and have concavities 111 for receiving the secondary springs 130. In this embodiment, the side beams 110 are formed from substantially square pipe steel. As shown in FIG. 3, each of the side beams 110 is formed such that four plate materials, i.e., a side beam outer wall 112, a side beam inner wall 113, a side beam lower wall 114, and a side beam upper wall 115 are bonded to each other by welding. Accordingly, a portion surrounded by the side beam outer wall 112, the side beam inner wall 113 and the side beam lower wall 114 becomes each of the concavities 111, and the secondary spring 130 is received in the concavity 111.

Here, the side beam outer wall 112 is the plate material which is located on an outer side in the railcar width direction 191 and extends in the railcar-longitudinal direction 192. The side beam inner wall 113 is the plate material which is opposed to the side beam outer wall 112, is located on an inner side with respect to the side beam outer wall 112 in the railcar width direction 191 and extends in the railcar-longitudinal direction 192. The side beam lower wall 114 is the plate material which extends in the railcar-longitudinal direction 192, and the secondary spring to be received is placed on the side beam lower wall 114. The side beam upper wall 115 has an opening 115*a* through which an upper portion 131 of the received secondary spring 130 projects, and is a plate material which extends in the railcar-longitudinal direction 192. In this embodiment, each of the side beams 110 has two openings 115*a* along the railcar-longitudinal direction 192. Hence, in each of the side beams 110, the concavities 111 for receiving the secondary springs 130 exist at two locations in the railcar-longitudinal direction 192. Further, in this embodiment, two secondary springs 130 are stored in each of the concavities 111.

Note that in each of the side beams 110, the number of concavities 111 for receiving the secondary spring 130, in other words, the number of the openings 115*a*, and the number of secondary springs 130 stored in each of the concavities 111 are not limited to those of the embodiment.

Although, in this embodiment, the side beam 110 and the concavity 111 are formed by the four plate materials, i.e., the side beam outer wall 112, the side beam inner wall 113, the side beam lower wall 114, and the side beam upper wall 115, the forming method thereof is not limited to this. In sum, it is only necessary to provide the side beam 110 with the concavity 111 for receiving the secondary spring 130.

Since a torsional force and a force caused by the secondary spring 130 act on the side beam 110 of the truck 101, the side beam 110 is required to have strength bearing with such forces. If a thickness of the entire steel material of the side beam 110 is increased to secure the strength, a weight of the truck 101 is increased. On the other hand, despite the fact that the side beam 110 most receives a force from the secondary spring 130, the opening 115*a* is formed in the side beam upper wall 115.

Figure 6:
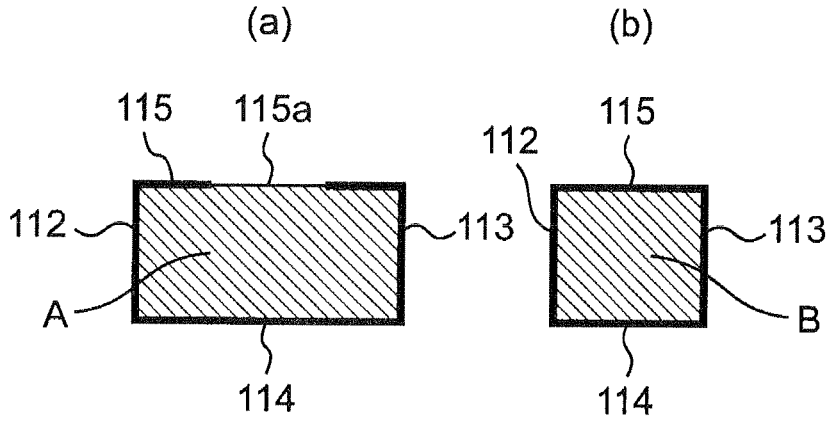
FIG. 6 is a diagram respectively showing cross-sectional areas of the portions A-A and B-B in FIG. 2.
Figure 7:
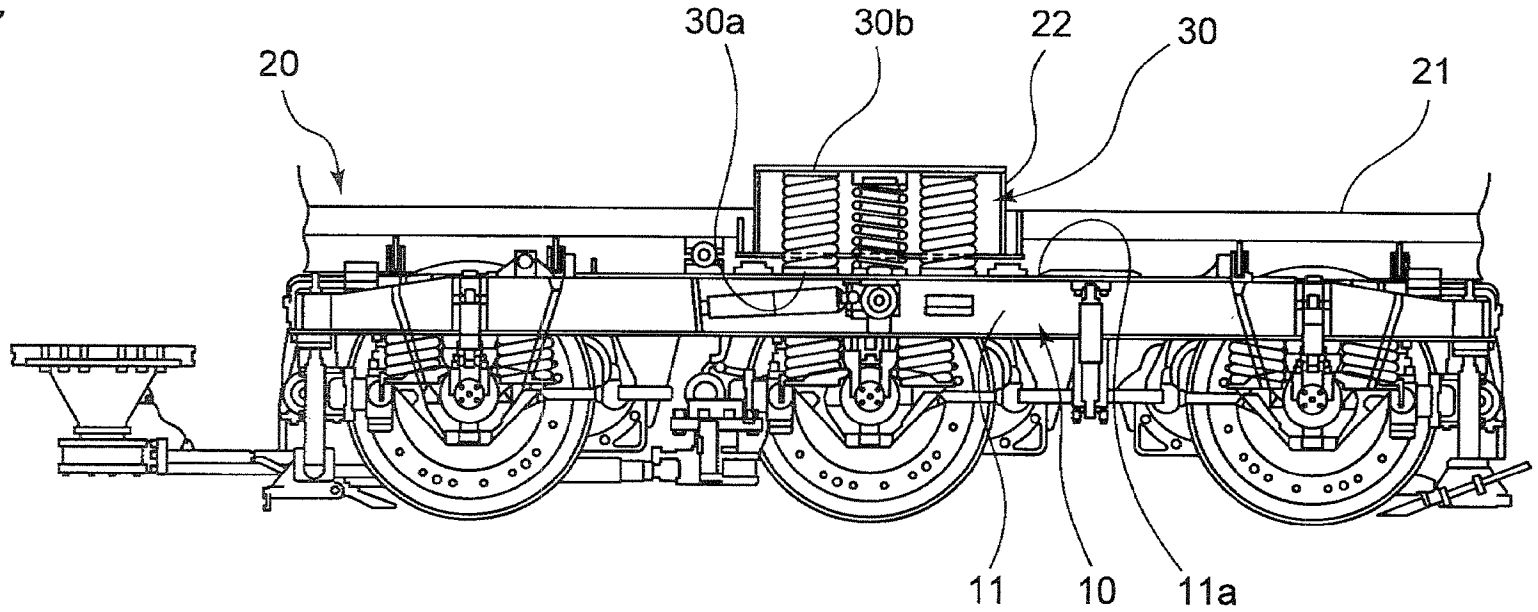
FIG. 7 is a side view showing one example of a conventional railcar truck.
Figure 8:
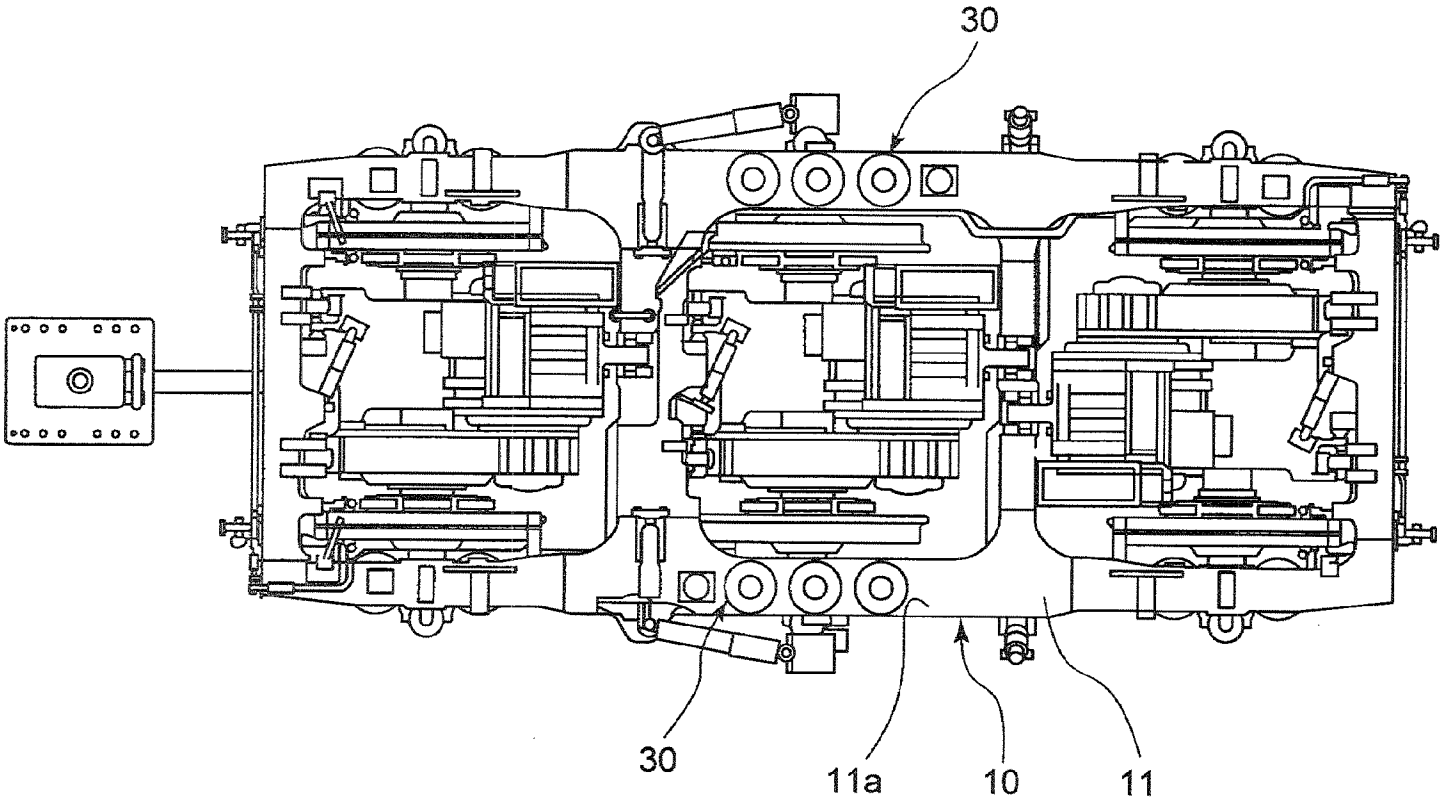
FIG. 8 is a plan view of the conventional railcar truck shown in FIG. 7.

Hence, in view of these points, in this embodiment, around the concavity 111 which receives the secondary springs 130, the side beam outer wall 112, the side beam lower wall 114 and the side beam upper wall 115 include a convex portion 117 which projects outward in the railcar width direction 191. By forming the convex portion 117, a cross-sectional area of an opening-existing portion 118*a* (corresponding to a portion A-A in FIG. 2) of the side beam 110 where the opening 115*a* is formed is greater than a cross-sectional area of an opening-non-existing portion 118*b* (corresponding to a portion B-B in FIG. 2) of the side beam 110 where the opening 115*a* is not formed. As shown in FIG. 6, the cross-sectional area means cross-sectional areas of the side beam outer wall 112, the side beam inner wall 113, the side beam lower wall 114 and the side beam upper wall 115 as well as an area of a rectangular portion surrounded by these walls 112, 113, 114 and 115. Therefore, the cross-sectional area A in the portion A-A shown by (a) in FIG. 6 is greater than the cross-sectional area B in the portion B-B shown by (b) in FIG. 6.

According to this configuration, torsional strength at the opening-existing portion 118*a* can be made equal to that of the opening-non-existing portion 118*b*.

In this embodiment, in order to enhance the torsional strength, the convex portion 117 is made to project outward in the railcar width direction 191 thereby setting the cross-sectional area A to be greater than the cross-sectional area B. Alternatively, the convex portion may project upward or downward only if the convex portion does not hinder a space for equipment within the carbody.

Further, in this embodiment, the convex portion 117 is provided as described above in terms of sizes between the side beam 110 and the secondary spring 130. However, it is possible, in some cases, to secure the strength by providing the opening-existing portion 118*a* with a later-described reinforcing member 140 (shown in FIG. 4A and the like). Thus, the convex portion 117 is not an absolutely necessary constituent member.

As described above, the side beam 110 has the concavity 111 for receiving the secondary spring 130. According to this, more than half of height of the secondary spring 130 can be received within the side beam 110 in a vertical direction 193 as shown in FIGS. 1 and 3. Thus, according to the truck 101 of this embodiment, a height of an upper surface 131*a* of the secondary spring 130 projecting from the side beam upper wall 115 can be set remarkably low as compared with the conventional technique. Therefore, it is unnecessary to set a floor level of the carbody high, or it is unnecessary to secure the installation space for the secondary spring by for example, forming a recess, which is only disposed corresponding to the secondary spring, at the under-frame of the carbody. Hence, since the space for equipment within the carbody can sufficiently be secured, it is unnecessary to increase the length of the carbody, and it is possible to prevent the production costs of the railcar from increasing.

As shown in FIG. 3, a drainage hole 116 may be formed in the concavity 111 storing the secondary springs 130 such that the drainage hole 116 penetrates the side beam lower wall 114. The drainage hole 116 is formed at a position where the drainage hole is not closed by the secondary springs 130.

By forming the drainage hole 116 in this manner, it is possible to prevent rainwater and the like from accumulating in the concavity 111.

Figure 4A:
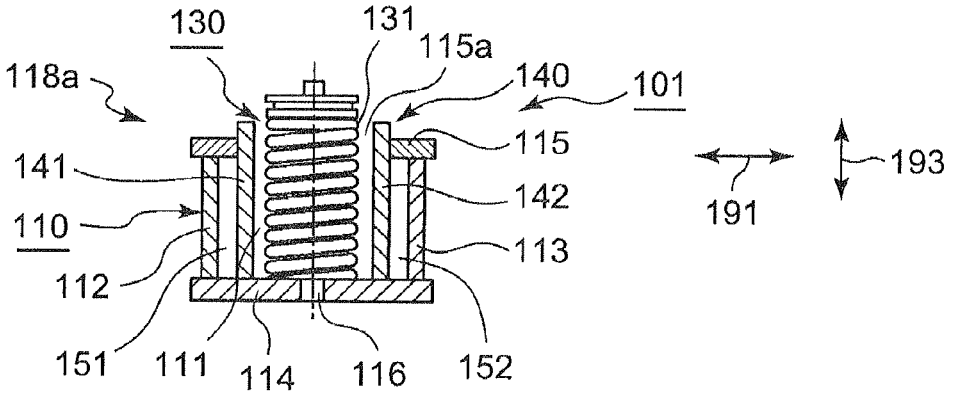
FIG. 4A is a sectional view showing one modification of a concavity shown in FIG. 3.
Figure 4B:
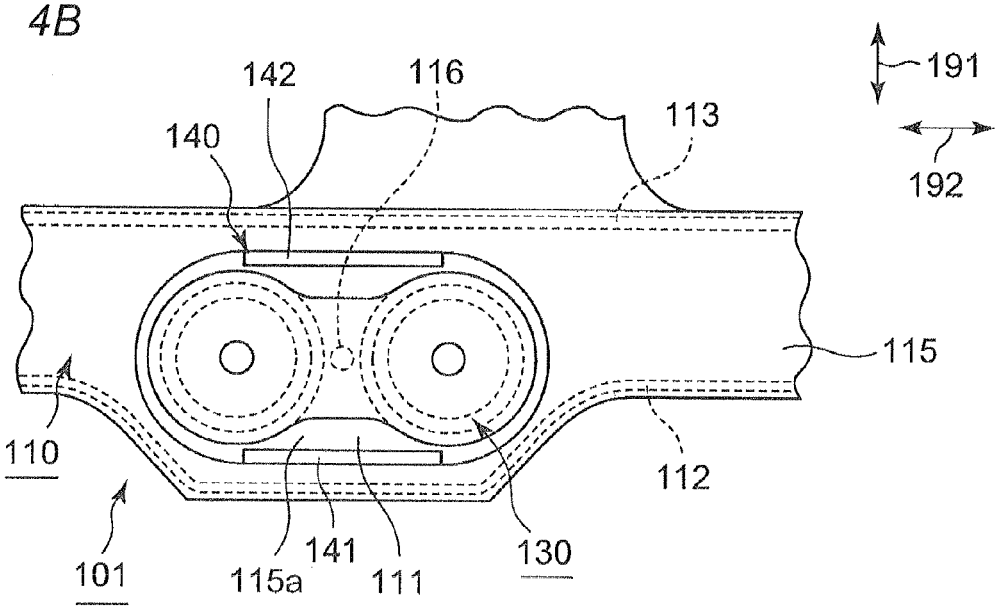
FIG. 4B is a plan view of the modification shown in FIG. 4A.
Figure 4C:
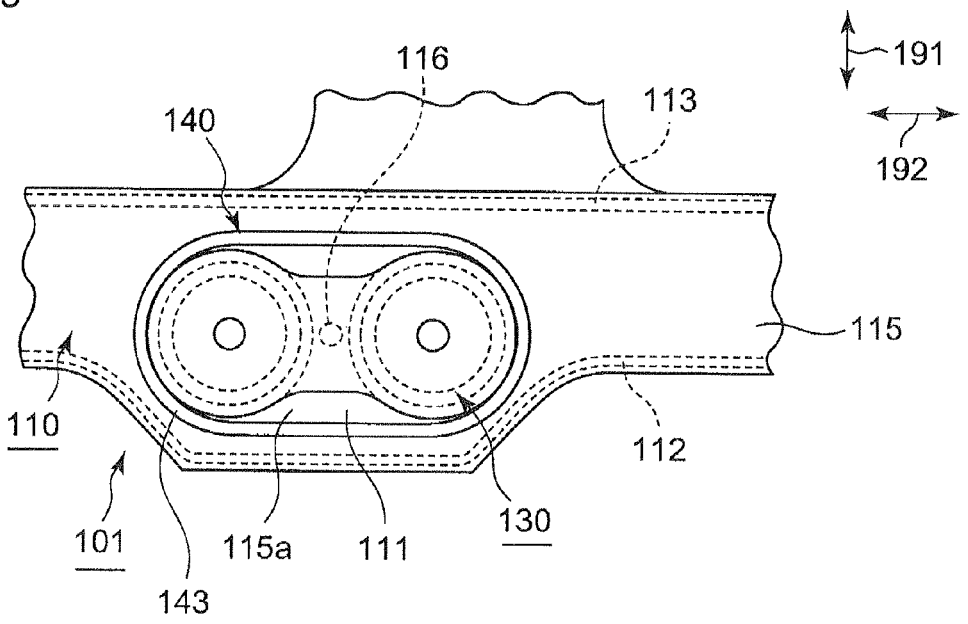
FIG. 4C is a plan view of another modification of the concavity shown in FIG. 3.
Figure 5:
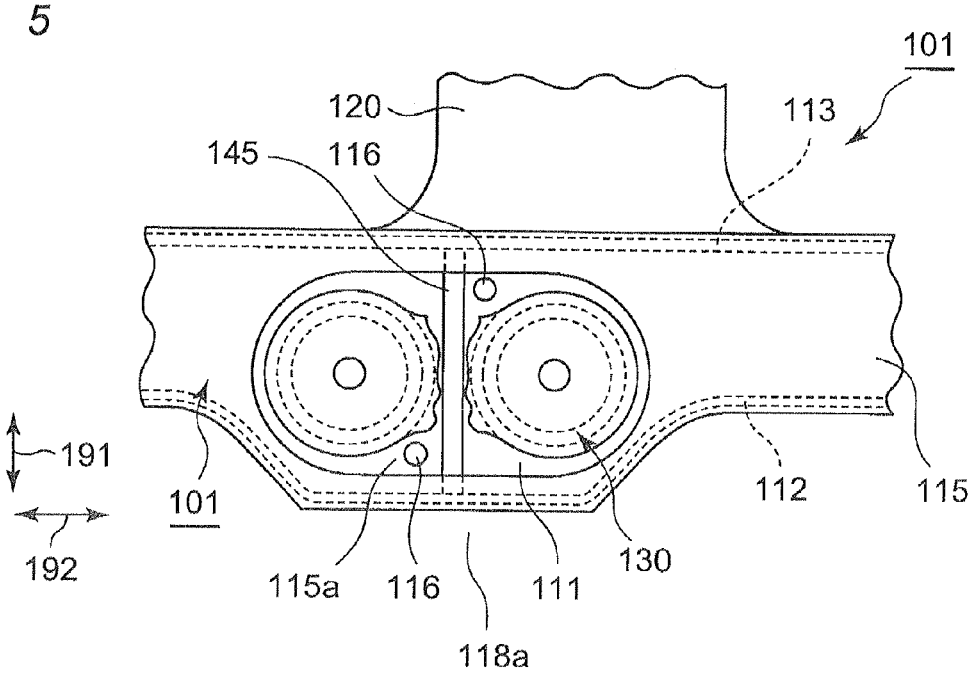
FIG. 5 is a plan view of another modification of the concavity shown in FIG. 3.

Further, as shown in FIG. 4 (FIGS. 4A to 4C), it is also possible to provide the concavity 111 receiving the secondary springs 130 with the reinforcing member 140. The reinforcing member 140 is a plate material arranged around the concavity 111 to correspond to the opening 115*a* of the side beam upper wall 115. For example, a first reinforcing member 141 and a second reinforcing member 142 as shown in FIG. 4B, a fourth reinforcing member 143 shown in FIG. 4C as a modification of the reinforcing members 141 and 142, and a third reinforcing member 145 as shown in FIG. 5 are included as the reinforcing member 140.

The first reinforcing member 141 is the plate material which is located between the side beam outer wall 112 and the opening 115*a* and extends in the railcar-longitudinal direction 192. A lower end of the first reinforcing member 141 is bonded to the side beam lower wall 114 by welding, and an upper end of the first reinforcing member 141 is bonded to the side beam upper wall 115 by welding. The second reinforcing member 142 is the plate material which is located between the side beam inner wall 113 and the opening 115*a* and extends in the railcar-longitudinal direction 192. A lower end of the second reinforcing member 142 is bonded to the side beam lower wall 114 by welding, and an upper end of the second reinforcing member 142 is bonded to the side beam upper wall 115 by welding.

As shown in FIG. 4A, both the first reinforcing member 141 and the second reinforcing member 142 are placed such that they are in contact with a peripheral surface of the opening 115*a* in this embodiment, however the embodiment is not limited to this configuration, and the first and second reinforcing members 141 and 142 may be placed closer to the side beam outer wall 112 or may be placed closer to the side beam inner wall 113 than the peripheral surface of the opening 115*a*.

It is also possible to employ such a configuration that the first reinforcing member 141 and the second reinforcing member 142 are integrally formed by connecting each other along an entire circumference of the opening 115*a* as the fourth reinforcing member 143 as shown in FIG. 4C.

By providing the opening-existing portion 118*a* with the first reinforcing member 141 and the second reinforcing member 142, or with the fourth reinforcing member 143 as described above, a rectangular first closed cross-section 151 is formed by the side beam outer wall 112, the side beam lower wall 114, the side beam upper wall 115 and the first reinforcing member 141, and a rectangular second closed cross-section 152 is formed by the side beam inner wall 113, the side beam lower wall 114, the side beam upper wall 115 and the second reinforcing member 142, as shown in FIG. 4A.

As described above, the torsional force and the force caused by the secondary springs 130 act on the side beam 110, and there is concern that strength of the opening-existing portion 118*a* with the opening 115*a* is lowered. However, since the first closed cross-section 151 and the second closed cross-section 152 are formed, it is possible to design such that torsional strength in the opening-existing portion 118*a* of the side beam 110 becomes substantially equal to that of the opening-non-existing portion 118*b* while suppressing increase in a weight of the truck 101.

Further, the truck 101 has a cross beam 120 which extends in the railcar width direction 191 and connects the pair of right and left side beams 110 to each other. As shown in FIG. 5, in some cases, the cross beam 120 is located close to the concavity 111 receiving the secondary spring 130, and a plurality of secondary springs 130 are stored in one concavity 111 in the railcar-longitudinal direction 192. According to such a configuration, a force from the cross beam 120 acts on the concavity 111 having the opening 115*a* formed in the side beam upper wall 115.

Thus, it is also possible to provide the concavity 111 storing the secondary spring 130 with the third reinforcing member 145.

The third reinforcing member 145 is the plate material extending along the railcar width direction 191 between the secondary springs 130 placed in the concavity 111. The third reinforcing member 145 is welded and fixed to at least the side beam outer wall 112 and the side beam inner wall 113, and it is preferable that the third reinforcing member 145 is also welded to the side beam lower wall 114 and the side beam upper wall 115.

By providing the third reinforcing member 145, even if the cross beam 120 is located close to the concavity 111 receiving the secondary springs 130, it is possible to enhance the strength in a portion of the side beam 110 on which a force from the secondary springs 130 acts while suppressing the increase in the weight of the truck 101.

When the third reinforcing member 145 is provided, the drainage holes 116 can be formed at respective regions where the concavity 111 is divided by the third reinforcing member 145, as shown in FIG. 5 for example.

The third reinforcing member 145 may be provided together with the first and second reinforcing members 141 and 142 or the fourth reinforcing member 143.

As described above, according to the railcar truck of the embodiment, the secondary springs are stored in the concavities in the side beams of the truck, and the upper portions of the secondary springs project through the openings of the side beam upper wall. Therefore, the height of the secondary springs from the truck can be made lower as compared with the conventional technique. Hence, it is unnecessary, unlike the conventional technique, to provide the installation space for the secondary springs which is recessed toward the carbody. Therefore, it is possible to secure the space for equipment on the side of the carbody, and it is possible to reduce the production costs as compared with the conventional technique.

Further, in the opening-existing portion, the railcar truck may further include the first reinforcing member which is located between the side beam outer wall and the opening and extends in the vertical direction from the side beam lower wall, and the second reinforcing member which is located between the side beam inner wall and the opening and extends in the vertical direction from the side beam lower wall. Here, the railcar truck may further include the rectangular first closed cross-section formed by the side beam outer wall, the side beam upper wall, the first reinforcing member and the side beam lower wall, and the rectangular second closed cross-section formed by the side beam inner wall, the side beam upper wall, the second reinforcing member and the side beam lower wall.

As described above, by including the first reinforcing member and the second reinforcing member in the concavity with the opening, it is possible to enhance the strength of a portion receiving the secondary spring in the truck while reducing the weight of the truck as compared with a configuration that strength of the entire members constituting the truck is enhanced. When the opening is formed in the side beam of the truck, there is concern that especially torsional strength of the side beam is lowered. In regards to this, by means of providing the first reinforcing member and the second reinforcing member and then forming the rectangular first and second closed cross-sections on both the left and right sides of the opening portion, it is possible to secure torsional strength which is substantially equal to that of the opening-non-existing portion of the side beam.

Further, in the configuration that the cross beam of the truck is placed in the vicinity of the concavity receiving the secondary spring, by means of providing the third reinforcing member with the concavity, it is possible to enhance the strength of the portion receiving the secondary spring in the truck with respect to a force from the cross beam.

Furthermore, by means of forming the drainage hole through the side beam lower wall of the concavity receiving the secondary spring, it is possible to prevent rainwater and the like from accumulating in the concavity.

It is to be noted that, by properly combining the arbitrary embodiments of the aforementioned various embodiments, the effects possessed by them can be produced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The entire disclosure of Japanese Patent Application No. 2012-104422 filed on May 1, 2012, including specification, claims, drawings, and summary is incorporated herein by reference in its entirety.

INDUSTRIAL APPLICABILITY

The present invention can be applied to trucks for railcars and more specifically, the invention is suitable for electric locomotive trucks, and various kinds of trucks for railcars which require securing a space for equipment within the carbody.

DESCRIPTION OF REFERENCE SYMBOLS

101 truck,
110 side beam,
111 concavity,
112 side beam outer wall,
113 side beam inner wall,
114 side beam lower wall,
115 side beam upper wall,
115*a* opening,
116 drainage hole,
118*a* opening-existing portion,
118*b* opening-non-existing portion,
130 secondary spring,
141 first reinforcing member,
142 second reinforcing member,
143 fourth reinforcing member,
145 third reinforcing member,
151 first closed cross-section,
152 second closed cross-section,
191 railcar width direction,
192 railcar-longitudinal direction, and
193 vertical direction.

The invention claimed is:

1. A railcar truck that comprises a pair of side beams and that is configured to support a carbody, wherein:

each of the side beams includes:

a side beam outer wall located on an outer side in a railcar width direction and extending in a railcar-longitudinal direction;

a side beam inner wall located on an inner side with respect to the side beam outer wall in the railcar width direction and extending in the railcar-longitudinal direction;

a side beam lower wall extending in the railcar-longitudinal direction and on which is placed a secondary spring by which the carbody can be supported;

a side beam upper wall having an opening through which an upper portion of the secondary spring projects, the side beam upper wall extending in the railcar-longitudinal direction; and a concavity that receives the secondary spring through the opening and that is formed by the side beam outer wall, the side beam inner wall, and the side beam lower wall, for each of the side beams, a cross-sectional area of an opening-existing portion where the opening is formed is greater than a cross-sectional area of an opening-non-existing portion where the opening is not formed, and in the opening-existing portion of each of the side beams, the railcar truck further comprises:

a first reinforcing member (i) located between the side beam outer wall and a center of the opening, (ii) spaced from the secondary spring, and (iii) extending from the side beam lower wall in a vertical direction;

a second reinforcing member (i) between the side beam inner wall and the center of the opening, (ii) spaced from the secondary spring, and (iii) extending from the side beam lower wall in the vertical direction;

the a rectangular first closed cross-section formed by the side beam outer wall, the side beam upper wall, the first reinforcing member, and the side beam lower wall; and a rectangular second closed cross-section formed by the side beam inner wall, the side beam upper wall, the second reinforcing member, and the side beam lower wall.

2. The railcar truck according to claim 1, wherein in the opening-existing portion of each of the side beams:

at least two of the secondary springs are placed in the opening such that the secondary springs are adjacent to each other, and a third reinforcing member extends along the railcar width direction between the secondary springs and is fixed to the side beam outer wall and the side beam inner wall.

3. The railcar truck according to claim 2, further comprising a cross beam extending in the railcar width direction and connecting the pair of side beams to each other, wherein for each of the side beams:

a plurality of the openings are arranged along the railcar-longitudinal direction, the concavity in at least one of the plurality of the openings includes the third reinforcing member, and the cross beam is located at a position close to a said opening having the third reinforcing member.

4. The railcar truck according to claim 1, wherein the side beam lower wall on which the secondary spring is placed further has a drainage hole.

5. The railcar truck according to claim 1, wherein the distance between the first reinforcing member and the second reinforcing member in the railcar width direction is greater than the outer diameter of the secondary spring.

6. The railcar truck according to claim 1, wherein bottommost surfaces of the first and second reinforcing members are coplanar with a bottommost surface of the secondary spring.

7. The railcar truck according to claim 1, wherein the first reinforcing member and the second reinforcing member are spaced toward the center of the opening from surfaces of the side beam inner wall and the side beam outer wall that form the concavity.

* * * * *